United States Patent [19]

Gray et al.

[11] 3,983,992

[45] Oct. 5, 1976

[54] ASSEMBLY OF TWO COMPONENT CLOSURE

[75] Inventors: Thomas W. Gray; Wendell Willingham, both of Toledo; Richard P. Secord, Wayne, all of Ohio

[73] Assignee: Owens-Illinois, Inc., Toledo, Ohio

[22] Filed: Oct. 31, 1975

[21] Appl. No.: 627,724

[52] U.S. Cl. ..... 198/381; 198/403; 198/408; 198/415

[51] Int. Cl.[2] ..... B65G 47/24

[58] Field of Search ..... 198/35, 266, 267; 113/121 A

[56] References Cited

UNITED STATES PATENTS 3,641,959 2/1972 Hurst ..... 113/121 A 3,920,132 11/1975 Cleland et al. ..... 198/267 X

*Primary Examiner*—Travis S. McGehee

*Attorney, Agent, or Firm*—A. J. Steger; E. J. Holler

[57] ABSTRACT

Apparatus and method for the assembly of a two component home canning closure. One popular type of home canning closure utilizes a relatively thin lid to seal a jar with a threaded band holding the lid down. The gasket portion of the lid is relatively fragile. In the assembly of the two components in a manufacturing process for shipment to the consumer, the lids are handled gasket upmost the minimize possible damage. At an assembly station, the lids are rotated 180° to present the gasket downward in the band for protection during shipment and storage.

7 Claims, 7 Drawing Figures

ASSEMBLY OF TWO COMPONENT CLOSURE

BACKGROUND OF THE INVENTION

This invention generally relates to home canning closures which have two components. More particularly, this invention relates to the assembly of the two components. Specifically, this invention relates to the assembly of the two components wherein a lid component is rotated through 180° during the assembly process.

The two-piece home canning closure is well known in the art. The lid member of these closures has a gasket portion which co-operates with the sealing surface of the finish of a glass container to seal the container. A threaded band member is screwed onto threads on the container finish and presses against the lid to help hold it in place. Shipping of the lid and band as a unit has presented some problems. Many such units are shipped on new home canning jars which they are designed to seal. The gasket portion is relatively fragile and subject to damage which could lead to a faulty seal on the filled jar. In particular, it is undesirable to assemble the band and lid to a new jar with the gasket down, in engagement with the sealing surface of the glass container. Shipping forces and plastic flow during storage can damage the gasket in such a case. It is desirable to handle the lids with the gasket upmost prior to assembly of the band and lid, again to protect the gasket.

U.S. Pat. Nos. 3,641,959 and 3,712,453 illustrate one technique for uniting lids and bands. However, these patents teach a system which requires the lid to enter the band with the same orientation it has held in the rest of its prior handling. We have devised a method and apparatus which allows handling of the lid with the gasket upmost and then rotates the lid through 180° as it is assembled with the band. This places the gasket in a position to be protected by the band during shipment and storage.

SUMMARY OF THE INVENTION

Our invention resides in a method and apparatus for the assembly of a two-piece closure. One part of the closure is a lid which has a peripheral gasket portion. The other part of the closure is a band member which has an internally threaded ring portion and a flange extending radially inwardly from one end of the ring. The method of assembly may be practiced by following these steps: sequentially supplying band members to an assembly zone with the flange of the band members downward; sequentially supplying lids to the assembly zone, with the gasket portion upmost, at an elevation above complimentary bands; aligning individual lids and bands in vertical registry in the assembly zone; releasing the lids from their position above the bands; moving the bands in a pre-determined path of travel while in alignment with the lids; and, rotating each lid through 180° while traveling with its mating band to thereby place the gasket downward in the band.

DETAILED DESCRIPTION OF THE DRAWINGS

Figure 1:
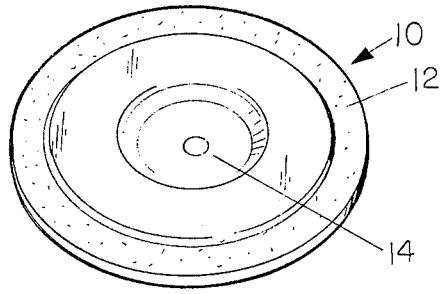
FIG. 1 is a perspective view of the gasketed side of the lid member of a two-piece closure assembled by the present invention.
Figure 2:
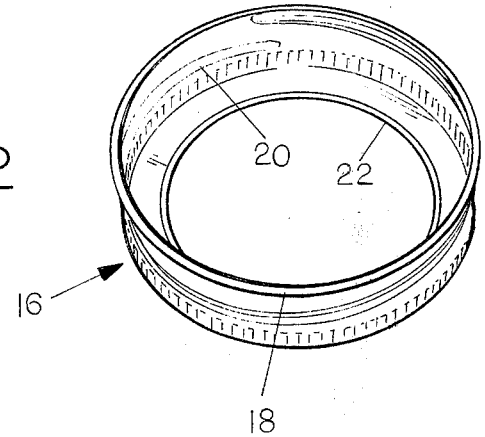
FIG. 2 is a perspective view of the band member of the two-piece closure assembled by the present invention.

FIGS. 1 and 2 illustrate the two components which together make up the home canning closure whose assembly is the subject of the present invention. FIG. 1 illustrates a lid member 10 as viewed from its underside. The lid member 10 is made of a relatively thin metal and includes a plastisol or rubber gasket area 12 which extends from its outer peripheral edge inwardly toward the center. The lid 10 may also include a center flip panel or button 14 which is pulled down in use and gives a visible assurance that vacuum is present in a jar on which the lid 10 is used. The gasket area 12 of the lid 10 is designed to sealingly engage the sealing surface of the finish of a jar. FIG. 2 illustrates a band member 16 which is used to hold the lid 10 in place on the jar. The band member 16 includes a relatively thin annular shell or ring portion 18 which has threads 20 formed on the interior of the ring 18. These threads 20 are designed to engage the threaded finish portion of a container on which the total closure is designed to be used. The band member 16 also includes an inwardly extending flange portion 22 which extends from the upper portion of the ring 18 inwardly toward the center. In practice, the flange portion 22 has a radial dimension which is approximately equal to or slightly greater than the radial dimension of the gasket area 12. Thus when the band member 16 is screwed onto a container over the lid 10, the flange 22 presses down tightly upon the gasket area 12 and helps insure a firm seal.

Handling of the lids 10 has proven to be some-what difficult in actual practice. The lids 10 are generally made of a relatively thin gauge metal and are therefore subject to bending when subjected to relatively small forces. In addition, the gasket area 12 is subject to damage during handling and processing steps, thus leading to possible failure when the lid 10 is placed into use. It is desirable to give as much protection as possible to the gasket area 12 from the time of its manufacture until the time when it is to be used by an ultimate consumer.

Many of the assemblies of lids 10 and band members 16 are placed on newly formed glass containers of the home canning jar variety for shipment. It is therefore desirable under these circumstances that the gasket area 12 not be in contact with the upper surface of the glass container finish, since continued contact during the shipment and storage period could conceivably cause damage to the gasket area 12. Therefore, the assembly process and machinery of the present invention have been devised primarily to allow assembly of the lid 10 and band member 16 just prior to their placement onto a glass container. However, this machinery and process could be used in any manufacturing line where these two components are made and where the end result to be shipped is a combination of the lid 10 and band member 16. As will be seen then, one of the objects of the present invention is to handle and allow shipping the lid member 10 so that its gasket area 12 is substantially protected from damage at all times. Further, it is also an aspect of the present invention to handle the lid members 10 in such a manner that they are not subjected to forces severe enough to cause bending or distortion of the lid members 10.

Figure 3:
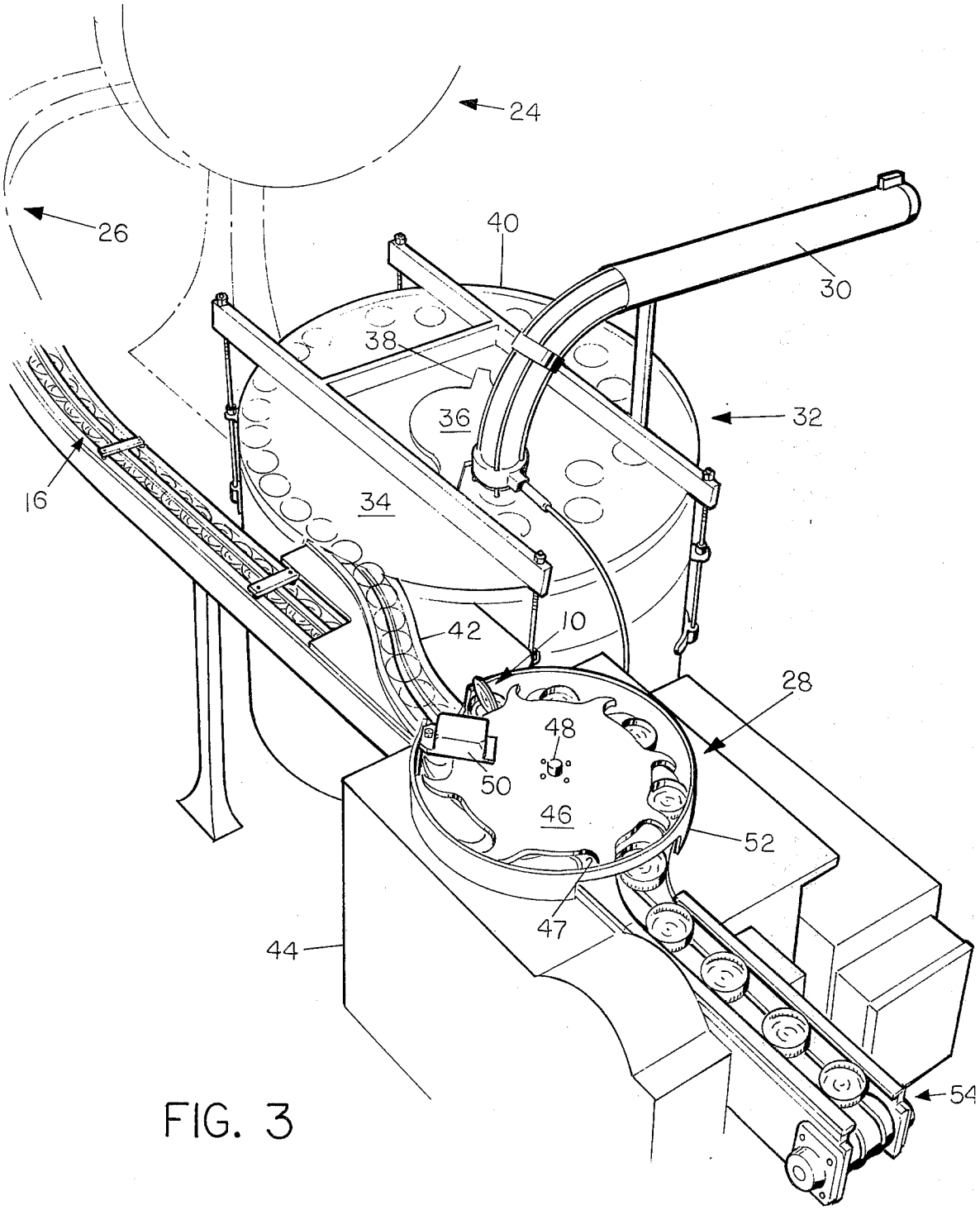
FIG. 3 is a perspective view of the entire assembly operation which is the subject of the present invention.

FIG. 3 illustrates the entire assembly apparatus of the present invention. The band members 16 are fed in bulk into a standard cap orienting machine 24. There are many types of these machines that are well known in the art, and their basic function is to orient closures of various types so that they are all facing in one direction. In this case, it is desired to orient all the band members 16 so that their flange portion 22 is downward and to convey them on the flange portion 22. The orienting takes place within the cap orienting machine 24 and oriented band members 16 are fed through an output chute 26. The output chute 26 conveys the oriented band members 16 toward an assembly machine generally designated as 28. Simultaneously, lids 10 are fed from an oriented supply of such lids through a chute 30 toward a lid single lining machine 32. The lids 10 which are fed by the chute 30 are already oriented all in one direction, so it is not necessary to perform the orienting step as is done to the ring band members 16 by the cap orienting machine 24. In addition, such orienting machines are not gentle in their handling of objects placed in them, and the gasket area 12 would likely be damaged by such handling. Therefore, the only purpose of the lid single lining machine 32 is to remove the lids 10 from a bulk stack and place them in a single file for mating with the band members 16. To this end, the stack of lids 10 which are fed by the chute 30 are preferably brought into physical contact with the top of a rotating table 34 with the gasket area 12 facing upwardly. The chute 30 has its terminal end near the center of the rotating table 34, so there is very little velocity component at this point and therefore little tendency for the lids 10 to be removed by the rotational forces alone. Attached to and rotating with the table 34 is a shear cam 36. The shear cam 36 includes at least one extending lobe portion 38 which will engage a lid 10 sitting on top of the table 34 and gradually accelerate it away from the mass of lids 10 being fed through the chute 30. It should be kept in mind that this step is relatively important to insure that the lids 10 are not damaged by a sudden or sharp blow to them by the shear cam 36. The shaping of the shear cam 36 therefore is relatively important to insure that the lids 10 are initially removed rather slowly from the stack of lids 10 and then gradually accelerated away from the stack. As seen in FIG. 3 there actually are two lobes 38 on the shear cam 36 illustrated.

The lids 10 thus freed from the stack are spun outward by centrifugal force against an outside stop rail 40. They are then transported by the rotation of the table 34 to a discharge chute 42 where they are peeled from the rail 40 and transported toward the assembly machine 28. The general type of system shown in the lid single lining machine 32 is known in the art in its basic configuration. That is, it is known to sort articles into a single file by using a rotating table which spins articles by centrifugal force out against a rail into a single file and then to remove this single file from the rail. However, it is believed that the use of a specifically configured shear cam 36 which rotates with the table 34 to prevent damage from articles being removed from a stack whose bottom most article rests on the rotating table 34 is an unusual application.

At the assembly machine 28, the discharge chute 42 brings the lids 10 in at an elevation above the output chute 26 which is transporting the band members 16. This entire general area of mating may be considered to be in assembly zone. The assembly machine 28 includes a base member 44 which may include a drive mechanism for powering two continuously rotating, vertically spaced apart star wheels 46 and 47. The star wheels 46 and 47 are carried by a common shaft 48 driven by a drive means, not shown in FIG. 3, contained within the base member 44. The star wheels 46 and 47 are vertically spaced apart a dimension generally corresponding to the vertical separation of the output chute 26 and the discharge chute 42. The actual assembly of the lids 10 and band members 16 is best seen with reference to FIG. 4, but generally speaking, at the juncture of the output chute 26 and discharge chute 42, the band members 16 are transferred onto pockets of the lower star wheel 47 while the lids 10 are pulled away from the discharge chute 42 by pockets of the upper star wheel 46. The star wheels 46 and 47 by acting as a unit assure proper vertical registry of the lids 10 and band members 16 as distinct, individual sets. A magnet 50 may be positioned adjacent the merger of the discharge chute 42 with the upper star wheel 46 to insure that any lids 10 engaged by the star wheel 46 are cleanly pulled away. The magnet 50 thus acts as an escapement member for the star wheel 46 in insuring that the lids 10 are firmly seated in the pocket of the star wheel 46 before they are completely removed from the discharge chute 42. As seen by the one lid 10 in FIG. 3 which is in a generally vertical configuration just past the magnet 50, the lids 10 are all rotated through 180° during their mating with the band members.

It will be recalled that the lids 10 were all delivered to the assembly machine 28 with their gasket area 12 facing upward. Therefore, when they are rotated 180° during assembly, the gasket area 12 will be facing downward. Remembering that the inwardly extending flange 22 of the band member 16 is at least radially as wide as the gasket area 12, it will be realized that the gasket area 12 will then be completely protected by the flange 22. A relatively tall guide rail 52 extends around a part of the star wheels 46 and 47 to help guide the progress of the lids 10 and band members 16. The assembled lids 10 and band members 16 are then removed from the assembly machine 28 by a continuously moving conveyor 54.

Figure 6:
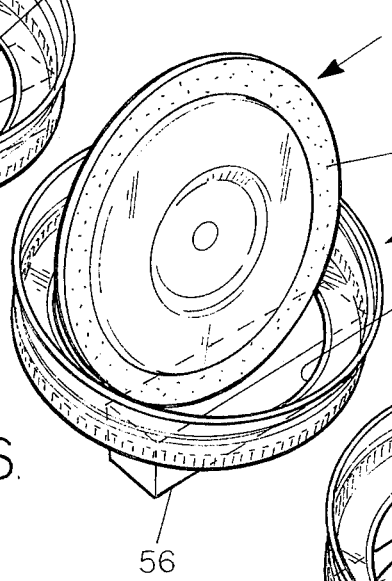
FIG. 6 is a schematic perspective view showing the relationship of the lid and band about half-way through the assembly process.
Figure 7:
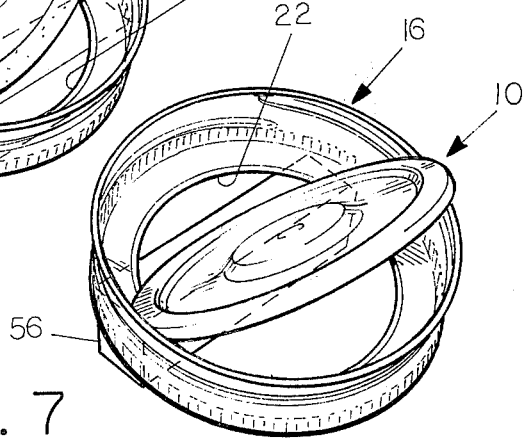
FIG. 7 is a schematic perspective view of the lid and band after the gasket of the lid has been turned to face the interior of the band and just prior to the lid falling into the band.
Figure 4:
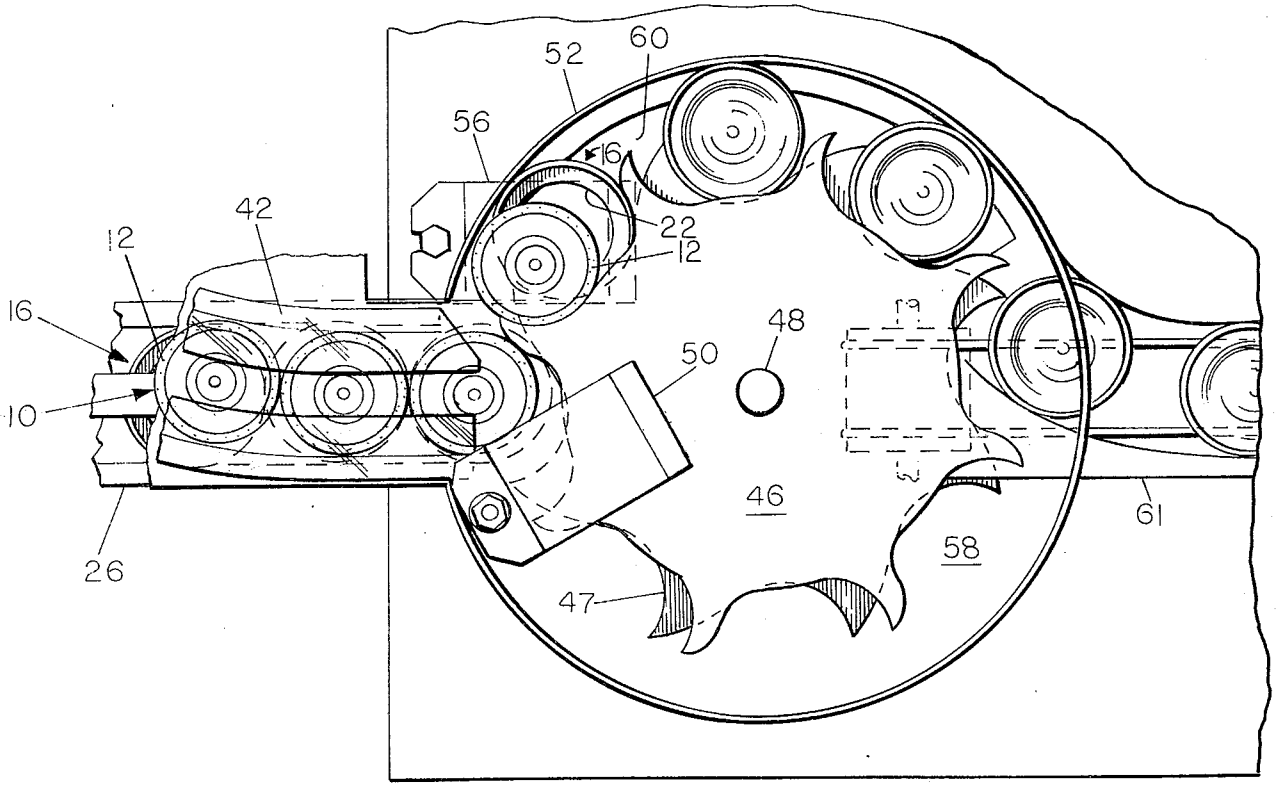
FIG. 4 is a top plan view, on an enlarged scale, of a portion of the assembly machine of the present invention.

The partial top view of FIG. 4 of the assembly machine 28 shows graphically the rotation of the lids 10 as they are assembled with the band members 16. FIG. 4 shows a second magnet 56 which was not visible in FIG. 3. The second magnet 56 is positioned below a slideplate 58 on which the band members 16 ride. The slideplate 58 is basically a continuous member to allow transport of the band members 16 by the lower star wheel 47. However, note that just prior to the juncture of the discharge chute 42 with the upper star wheel 46, the slideplate 58 has been cut out to form a slot portion 60. The slot portion 60 is made wide enough so that only the flange portion 22 of the band member 16 is supported during movement through this area. The slot portion 60 is necessary to allow rotation of the lid 10 through 180° during its assembly into the band member 16. As the lid 10 is peeled from the discharge chute 42 by the upper star wheel 46, the normal tendency would be for the lid 10 to drop straight downward into the band member 16. However, the magnetic field exerted by the magnet 56 below the band members 16 holds the lid 10 in a somewhat upright position, and continues to hold the lid 10 while the band member 16 actually moves under it. The net result of this combination of forces and movement is that the lid member 10 pivots about the edge of the flange 22 through 180° as the band member 16 is moved forward by the star wheel 47. Note that the star wheel 46 which initially moves the lid 10 away from the discharge chute 42 is retarded somewhat from the position of the lower star wheel 47. This allows the band 16 to be somewhat in advance of the lid 10 before the lid 10 leaves the discharge chute 42 and begins to fall. There is substantial vertical registry of the lid 10 and band 16 even though the band 16 is leading somewhat. This movement is somewhat difficult to visualize and the schematic drawings of FIGS. 5, 6 and 7 are included to graphically demonstrate this relationship.

Figure 5:
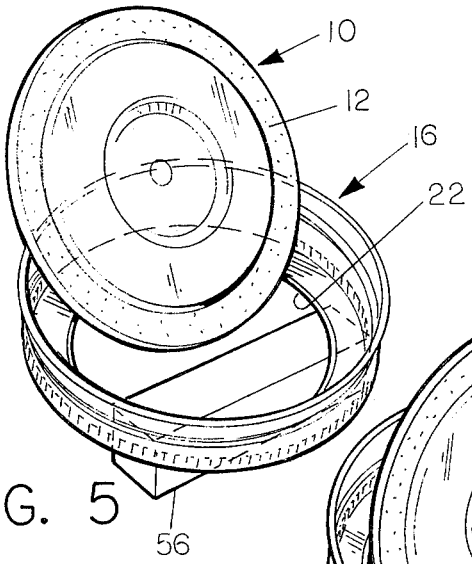
FIG. 5 is a schematic, perspective view showing initial contact of the lid and band during assembly.

In FIG. 5, the lid is just entering the band 16 and is coming under the influence of the magnet 56. Again note that under normal circumstances, the lid 10 would simply slide into the band 16, with gasket 12 upward. In FIG. 6, the lid 10 is held completely upright by the magnetic field from the magnet 56. While it is perhaps not completely evident in FIG. 6, the lid 10 is actually pivoting about a chordal dimension at this point. Finally, FIG. 7 shows the action which occurs as the band 16 finally begins to leave the influence of the magnetic field of the magnet 56. The lid 10 is retarded somewhat by the magnetic field relative to the motion of the band 16, this motion being to the right as viewed in FIG. 7. The result is that the lid 10 pivots about a chordal dimension and is rotated through 180° by this action. This then presents the gasket 12 downward where it is protected by the flange 22 from damage. Finally, the now assembled band member 16 and lid 10 are directed from the star wheels 46 and 47 by a guide rail 61 onto the output conveyor 54.

It should be realized of course that the magnetic field presented by the magnet 56 may be generated in any manner desired, as for example, by an electromagnet, although the magnet 56 actually illustrated in FIG. 4 is a solid bar-type magnet. Additionally, the magnet 50 used as an escapement is an optical or auxiliary feature, and the device would work without the use of such a magnet. However, it is a useful device to insure a clean transfer from the discharge chute 42 to the influence of the upper star wheel 46.

What is claimed is:

1. A method for assembling a two-piece closure, said closure including a lid having a peripheral gasket portion and a band member having an internally threaded ring portion and a flange extending radially inwardly from one end of said ring portion, said method comprising the steps of:

sequentially supplying said band members to an assembly zone with said flange downward;

sequentially supplying said lids to said assembly zone, with said gasket portion upmost, at an elevation above complementary bands;

substantially aligning individual lids and bands in vertical registry in said assembly zone;

releasing said lids from their position above said bands;

moving said bands in a pre-determined path of travel while in alignment with said lids; and rotating each lid through 180° while traveling with its mating band to thereby place said gasket downward.

2. The method of claim 1 wherein the step of rotating each lid through 180° includes the steps of:

subjecting each released lid to a magnetic field;

retarding the movement of said lid relative to its moving, mating band as a function of the force of said magnet field; and pivoting said lid about a chordal dimension in contact with said band as a result of the retardation of said lid.

3. An apparatus for assembling a two-piece closure, said closure including a lid having a peripheral gasket portion on one side thereof and a band member having an internally threaded ring portion and a flange extending radially inwardly from one end of said ring portion said apparatus comprising, in combination:

means for orienting and supplying said band members in a single file in a flange down configuration to a fixed location;

means for supplying said lids in a single file in a gasket up configuration to said fixed location, said lids being supplied to said fixed location at a vertical elevation above said bands;

means, positioned to receive lids and bands from said fixed location, for subtantially aligning individual lids and bands in vertical registry and for moving said bands in a pre-determined path; and means, positioned adjacent said aligning means, for generating a magnetic field to retard the movement of said lids with said bands sufficiently to force said lids to rotate through 180° before completely entering said bands.

4. The apparatus of claim 3 wherein said means for substantially aligning individual lids and bands includes:

a pair of vertically spaced-apart pocketed star wheels, carried on a common, continuously rotating shaft, an upper one of said star wheels being positioned to engage said lids and a lower one of said star wheels being positioned to engage said bands.

5. The apparatus of claim 4 wherein the pockets of said upper star wheel are retarded relative to the pockets of said lower star wheel.

6. The apparatus of claim 5 which further includes:

means for generating a magnetic field, adjacent the point at which said lids are engaged by said upper star wheel, for acting as an escapement for said lids to insure proper seating in a pocket of said upper star wheel.

7. The apparatus of claim 3 wherein said means for supplying said lids includes:

a continuously rotating table;

a supply of said lids is a columnar stack, the bottom of said stack resting on the surface of said rotating table near the center thereof;

a shear cam, moving with said rotating table, having at least one lobe for contacting the bottom most lid in said stack of lids and removing it from said stack to be moved to the outer periphery of said table by centrifugal force;

a stop rail at the outer periphery of said rotating table for intercepting said lids and forcing said lids to move in a single file; and a discharge chute for removing lids from said table and directing said lids toward said fixed location.

* * * * *